US005685341A

United States Patent [19]

Chrysler et al.

[11] Patent Number: 5,685,341

[45] Date of Patent: Nov. 11, 1997

[54] WATER FAUCET WITH QUICK-CONNECT SOCKET

[75] Inventors: Jimmie D. Chrysler, Wyoming; Robert S. Creswell, Grand Rapids, both of Mich.

[73] Assignee: Amerikam, Inc., Grand Rapids, Mich.

[21] Appl. No.: 711,197

[22] Filed: Sep. 10, 1996

[51] Int. Cl.[6] ..... E03C 1/04

[52] U.S. Cl. ..... 137/801; 4/677; 285/321

[58] Field of Search ..... 4/676, 677; 137/606, 137/801; 281/151; 285/321

[56] References Cited

U.S. PATENT DOCUMENTS 5,172,941 12/1992 Pawelzik et al. ..... 285/321 X 5,558,128 9/1996 Pawelzik et al. ..... 137/801

*Primary Examiner*—Gerald A. Michalsky

*Attorney, Agent, or Firm*—Varnum, Riddering, Schmidt & Howlett LLP

[57] ABSTRACT

The socket member for mounting within a faucet and special fittings for water leads are disclosed which enable the fittings on the water leads to be quickly and easily mounted to the socket member within the faucet without the use of tools is disclosed. The socket member comprises a generally cylindrical or semicylindrical body which mounts a conventional valve assembly in the faucet. The socket member further contains several sockets on one axial end which mount corresponding fittings on a water lead via a resilient locking ring located within an annular groove within each socket which abuts against a shoulder located on each fitting to provide a locking engagement between the water lead and the socket member. A fitting is also disclosed having a polygonal circumference which prevents the installed water leads from rotating within the sockets via the abutment of the polygonal circumference against a fitting on another water lead or against upstanding walls adjacent the sockets.

20 Claims, 4 Drawing Sheets

WATER FAUCET WITH QUICK-CONNECT SOCKET

BACKGROUND OF THE INVENTION

1. Field of the Invention

This invention relates to faucet assemblies and, more particularly, to a device for retaining water supply leads in fluid connection with a faucet assembly.

2. Description of Related Art

As shown in FIG. 1, a typical single-handed water faucet 10 comprises a generally cylindrical body 12, a handle 14 and a spout 16. The body 12 includes a socket member 18 mounted therein which couples one or more hot or cold water leads 20 to a valve assembly 22 so that actuation of the handle 14 causes hot and cold water to be mixed at a desired ratio depending upon the position of the handle 14. The water is then delivered to and dispensed from the spout 16 at a preselected temperature. The water leads 20 typically extend from a conventional valve assembly 34 which controls the main water supply to the faucet 10. A typical water lead 20 further includes a distal threaded end 23 on which one or more O-ring seals 36 are mounted.

The socket member 18 typically has a first end 24 provided with at least two axially-extending threaded bores 26 and a second end 28 comprising a cylindrical wall 30 which defines an internal chamber 32 adapted to receive a conventional ball-type valve portion of the valve assembly 22 for mixing of hot and cold water in a ratio depending upon the actuation position of the handle 14. The bores 26 extend through the first end 24 so as to communicate with the chamber 32. Each bore 26 receives a tightly threaded end of a water lead 20 which is sealed therein by an O-ring seal 36 (as shown), or by other conventional means such as Teflon™ tape, "pipe dope", or even by soldering a copper water lead 20 thereto. The socket member 18 typically can be adapted to receive as many leads 20 as needed according to the particular design, including such things as a flexible hose nozzle (not shown) usually mounted adjacent to the faucet 10.

The socket member 18 and the water leads 20 are typically preassembled at the factory. Each first end 24 is usually rotatable relative to the lead 20 itself and comprises a nut portion, usually hexagonal, by which it can be rotated. Assembly is accomplished by simply turning (by wrench or similar tool) the threaded rotatable end of each water lead 20 within a corresponding threaded bore 26 in the socket member 18 until a sufficient degree of engagement between the water lead 20 and the socket member 18 is obtained. Assembly of this structure, however, is highly labor-intensive and presents some problems. It is important not to over tighten the threaded ends of the leads 20 within the bores 26 so as to avoid stripping the threads, thereby destroying the connections. On the other hand, sufficient torque must be applied in order to ensure a watertight seal. Moreover, once the first lead is secured, it is difficult to assemble the second and subsequent leads because the first lead will block efficient use of a wrench. The rotation of the tool usually abuts the first water lead 20 before the tool has traversed enough of an arc to be effective in tightening the water lead 20.

SUMMARY OF THE INVENTION

The invention addresses these problems by an improvement in the structure of a conventional faucet assembly having at least one water supply lead with a fitting and at least one socket adapted to receive the fitting in sealing engagement where the water supply lead and the fitting have some portion thereof rotatable relative to the faucet assembly when the fitting is in sealing engagement. Such rotatable portion is typically a hexagonal nut. The invention comprises a member adapted to be positioned between the water supply lead and the faucet assembly when the fitting is received within the socket. The member has a recess with an axial discontinuity adapted to engage an annular discontinuity on the rotatable portion so that when the fitting is received within the socket, the rotatable portion will be received within the recess and will be prevented from rotating when the annular discontinuity engages the axial discontinuity.

Preferably, the annular discontinuity of the rotatable portion is defined by an outer edge of a polygonal surface, typically a hexagonal shape. Similarly, the recess in the member is formed by an annular shoulder, and the annular discontinuity is defined in the outer edge of a polygonal shape. Again, typically, the polygonal shape is a hexagon corresponding in dimension to the hexagonal shape of the rotatable portion.

In one aspect of the invention, the member has more than one recess, with each recess adapted to receive a separate water supply lead. In another aspect of the invention, the faucet assembly includes a socket member having at least one socket to receive the water supply lead, and the member comprises a separate plate interposed between the water lead and the socket member.

BRIEF DESCRIPTION OF THE DRAWINGS

The invention is described with reference to the drawings wherein.

DESCRIPTION OF THE PREFERRED EMBODIMENTS

Figure 1:
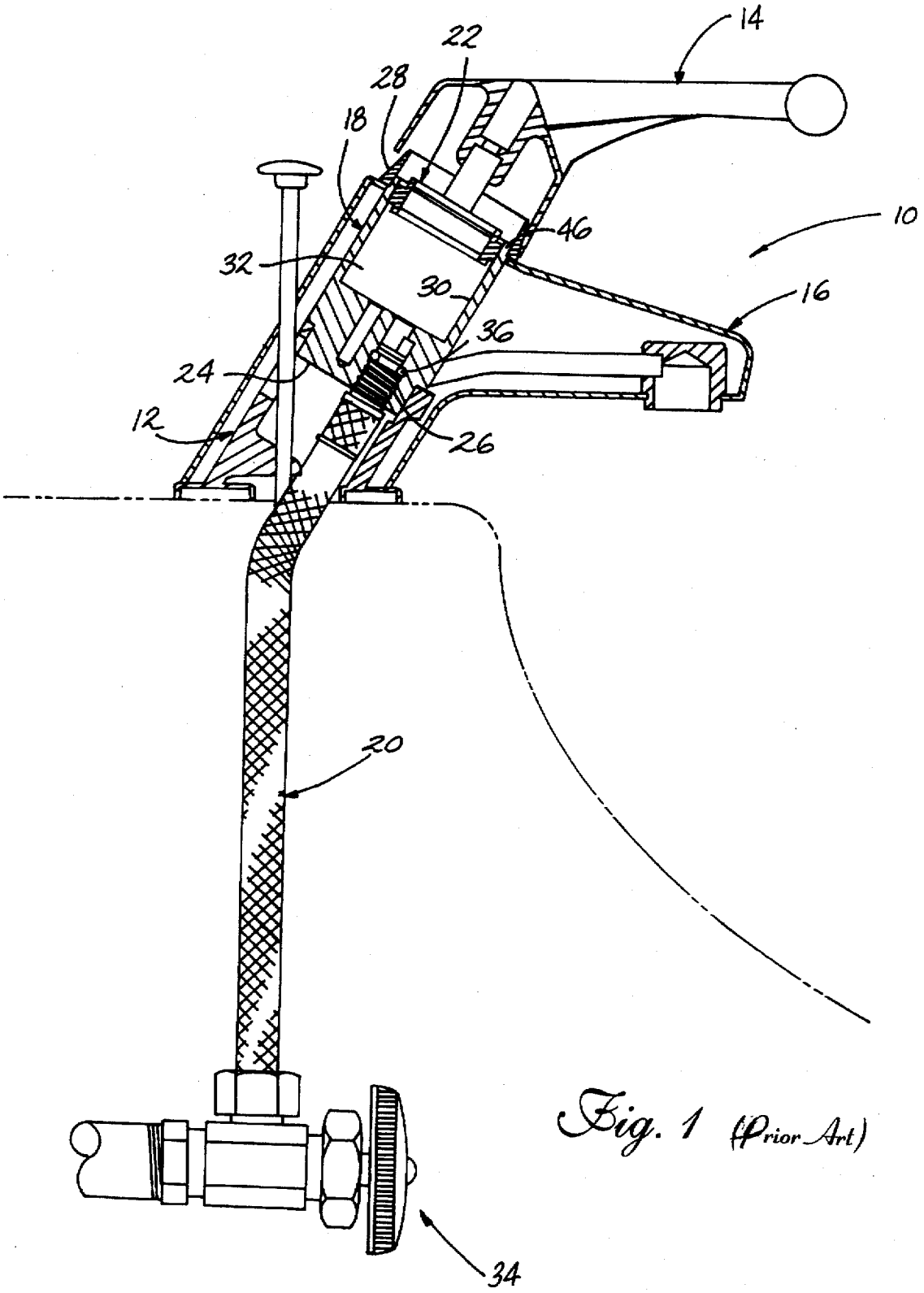
Fig. 1 (Prior Art)
FIG. 1 is a side elevational diagrammatical view of a prior art faucet assembly.
Figure 2:
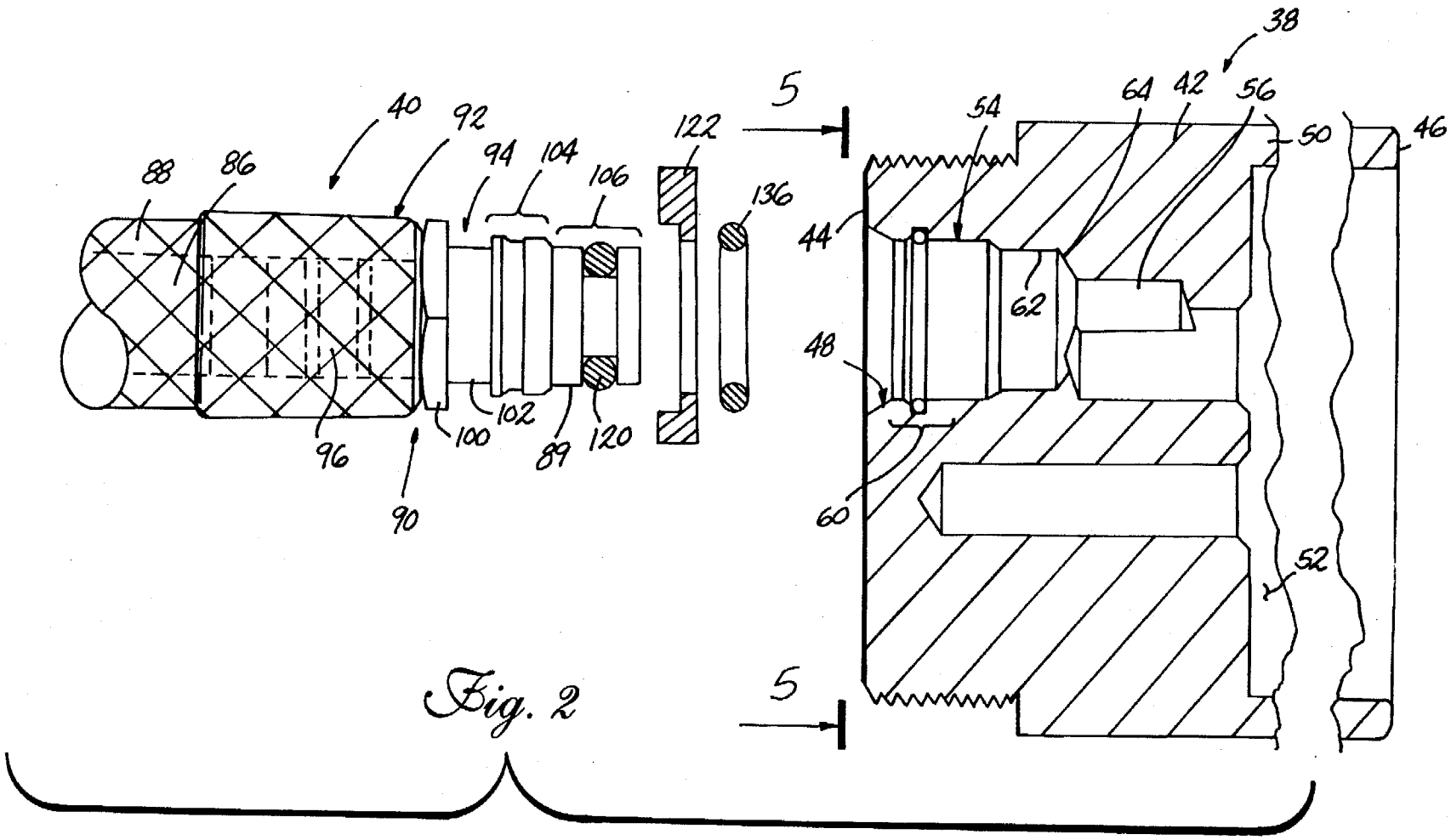
FIG. 2 is an exploded side view of a faucet assembly provided with a socket member and water lead assembly according to the invention.
Figure 3:
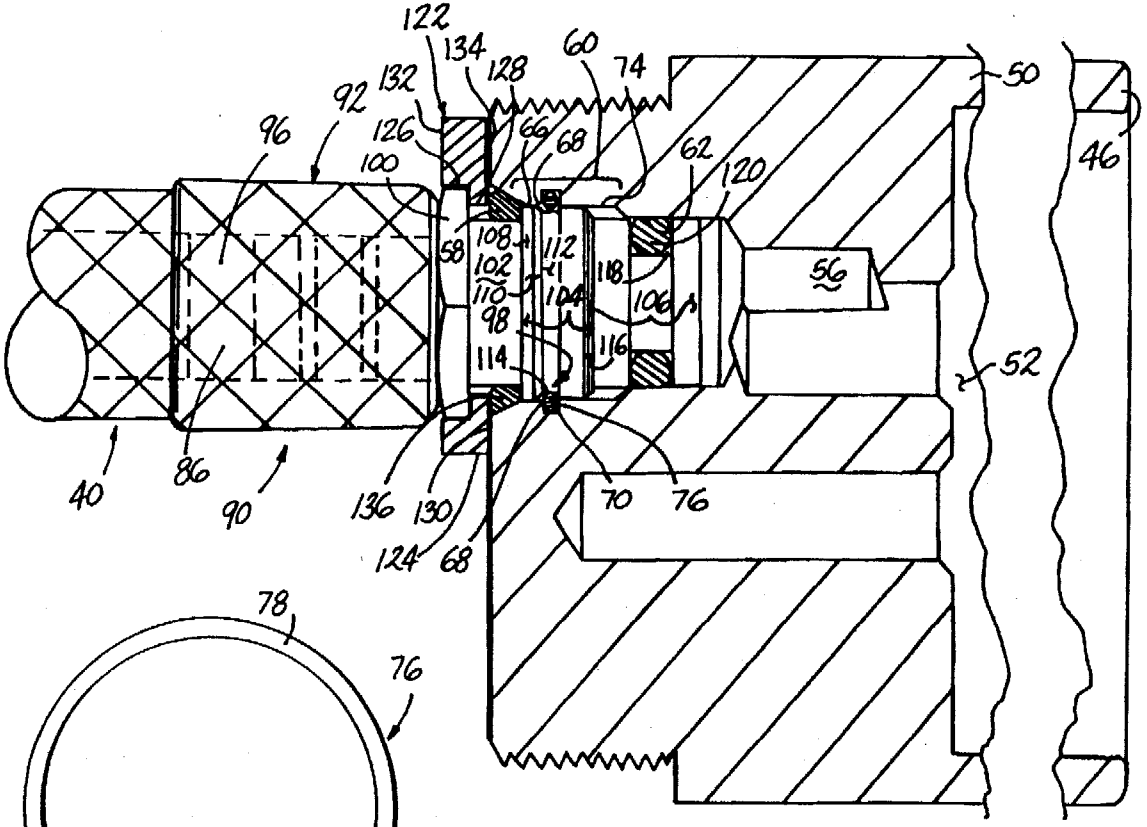
FIG. 3 is an assembled side view of the socket member and water lead assembly of FIG. 2 according to the invention.
Figure 4:
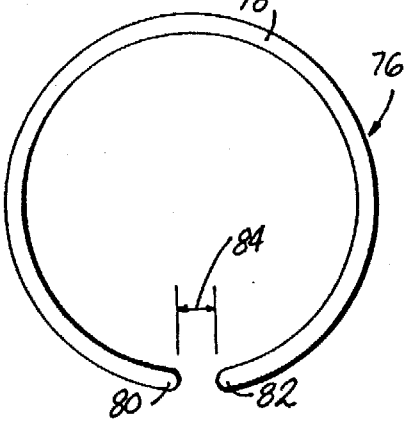
FIG. 4 is a plan view of a locking ring used in the socket member of FIG. 2.
Figure 5:
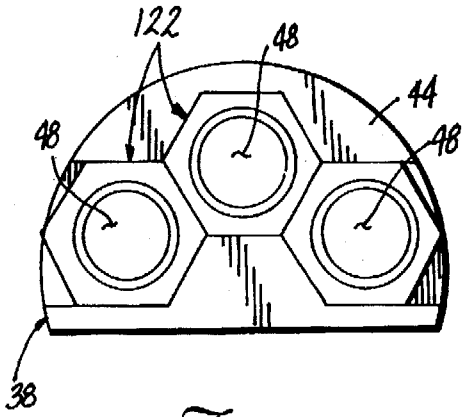
FIG. 5 is a plan view of the socket member of FIG. 2.
Figure 6:
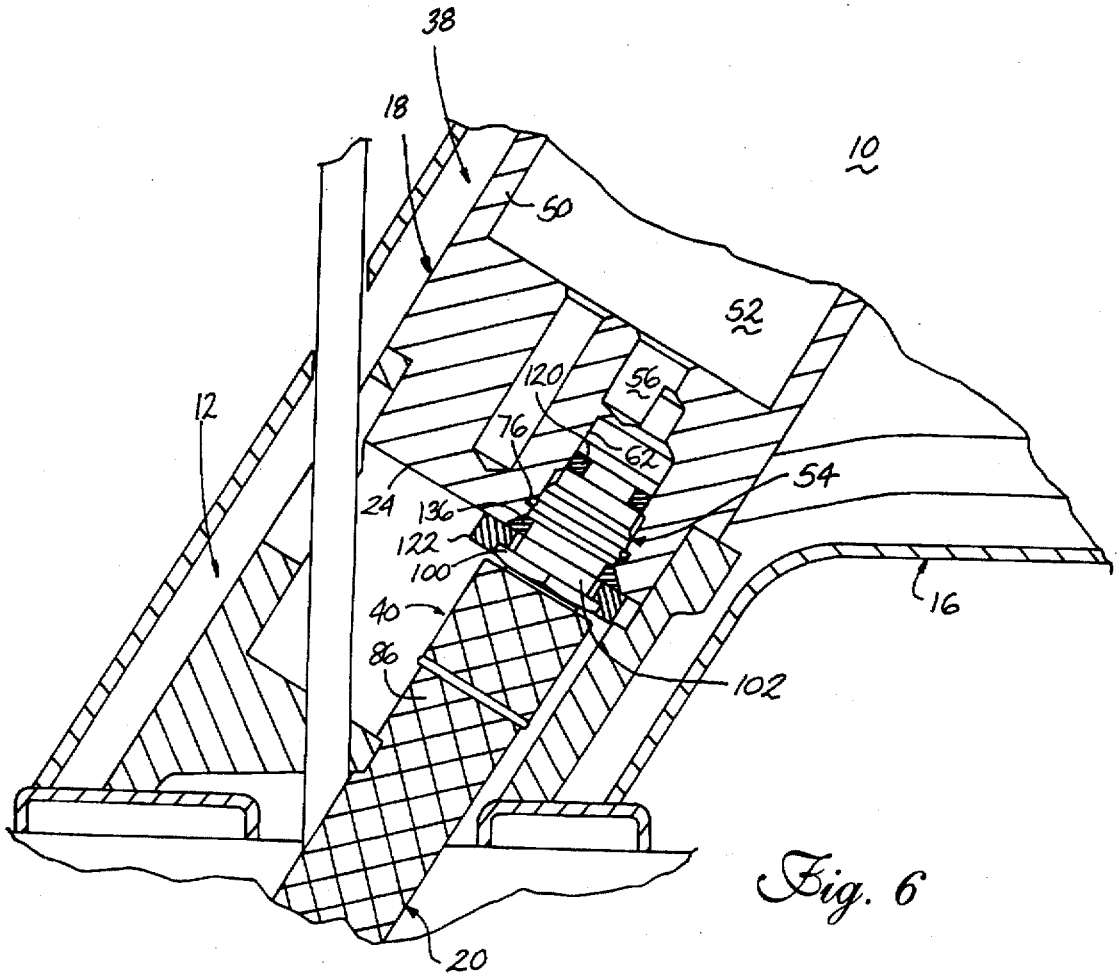
FIG. 6 is an enlarged fragmentary view of the connected water lead and socket member assembly according to the invention mounted within a typical faucet.

Referring now to the drawings and to FIGS. 2–6 in particular, a socket member 38 adapted to receive one or more water leads 40 is shown. The socket member 38 is adapted to sealingly mount a plurality of water leads 40 without requiring the use of tools to initiate, provide, or maintain the sealed engagement between the socket member 38 and the water leads 40. In addition, a fitting 122 is provided for each water lead 40 to ensure that the engagement between the socket member 38 and the water leads 40 prevents the water leads 40 from axially rotating while mounted to the socket member 38 thereby preventing the impression that the water leads are "loose" and further preventing wear and fatigue on the components due to abrasion between the rotating water leads 40 and the socket member 38.

The socket member 38 comprises a generally cylindrical body 42 having a first end 44 and a second end 46. The first end 44 of the body 42 is provided with one or more sockets 48. As shown in greater detail in FIG. 2, the first end 44 of the body 42 is preferably provided with three sockets 48 in a spaced relationship, although it will be understood that a greater or fewer number of sockets 48 can be provided therein without departing from the scope of this invention. The number and orientation of the sockets 48 and the first end 44 of the body 42 should preferably correspond with the number and orientation of the water leads 40 desired to be mounted thereto. The second end 46 of the body 42 comprises a cylindrical wall 50 of a relatively thin width which defines an interior cylindrical chamber 52. The cylindrical wall 50 adjacent the second end 46 of the body 42 is provided with teeth, threads or other fastening means on the interior or exterior surface of the wall 50 so that the second end 46 of the socket member 38 will mount a conventional valve assembly 22 which includes one or more slots therein for mixing the hot and cold water from the water leads 40 depending on the actuation of the handle 14 shown by example in FIG. 1.

The sockets 48 each comprise a specially-shaped inlet conduit 54 which extends axially inwardly of the first end 44 of the socket member 38 and terminates in a cylindrical outlet conduit 56 which, in turn, extends into the chamber 52. The inlet conduit 54 comprises an inwardly-tapering frustoconical wall 58 adjacent the first end 44 of the socket member 38 which extends into a locking region 60 and which terminates in a narrower cylindrical conduit 62. The cylindrical conduit 62 includes, at its inward end, a tapering frustoconical wall 64 which extends into the outlet conduit 56. The locking region 60 comprises a generally cylindrical conduit 66 extending inwardly from the inward portion of the frustoconical wall 58. A radially-increasing frustoconical portion 68 is located inwardly of the conduit 66 which extends into a radially-extending annular groove 70 and further into a narrower cylindrical conduit 72 which terminates at a tapering frustoconical portion 74. The frustoconical portion 58, locking region 60, cylindrical conduit 62 and outlet conduit 56 each are concentrically aligned and extend inwardly in succession from the first end 44 of the socket member 38. A split ring 76 is received within the annular groove 70 within the locking region 60. As shown in greater detail in FIG. 4, the split ring comprises a solid circular ring portion 78 having first and second ends 80 and 82, respectively, which define a gap 84 therebetween and is of a resilient nature so to permit mechanical reduction or expansion of the diameter of the ring 76. After a mechanical reduction or expansion has been performed, the ring 76 will return to is unexpanded diameter. The unexpanded diameter of the ring 76 is slightly less than the outer diameter of the annular groove 70 so that when the ring 76 is mounted within the annular groove 70, the ring 76 extends beyond the annular groove 70 and into the inlet conduit 54. The outer diameter of the annular groove 70 is of such an extent that the outer diameter of the ring 76 can be expanded so that no portion of the ring 76 extends beyond the annular groove 70.

Each water lead 40 generally comprises a conduit 86 surrounded by a protective casing 88. A distal end 90 of each water lead 40 includes an end cap 92 which mounts a fitting 94 adapted to be received within a corresponding socket 48 on the socket member 38. The fitting 94 comprises a first end 96 adapted to be received by an end of the conduit 86 and a second end 98 adapted to be received by a corresponding socket 48 on the socket member 38. The fitting 94 includes a longitudinal central bore (not shown) so that when the fitting 94 is mounted to the conduit 86 and within a socket 48, the central bore fluidly connects the conduit 86 with the interior of the socket member 38. A member having an annular discontinuity such as hexagonal flange 100 is disposed between the first and second ends 96 and 98, respectively. It will be understood that the flange 100 can have any shape whereby rotation is prevented when the flange 100 is engaged against an adjacent surface. The first end 96 of the fitting 94 can be provided with threads or a series of opposed resilient protrusion so that the first end 96 can be either threaded onto or press fit within an end of the conduit 86. Alternatively, the end cap 92 can be provided with pitched threads along its interior surface so that the end cap 92 can be threaded onto the exterior surface of the casing 88 surrounding the conduit 86. The second end 98 of the fitting 94 comprises a first cylindrical portion 102, a locking region 104 and a second cylindrical portion 106 all of which are concentrically aligned and extend axially in succession from the hexagonal flange 100 of the fitting 94. The locking region 104 comprises a cylindrical portion 108 which extends into an inwardly tapering frustoconical portion 110. The frustoconical portion 110 extends into a cylindrical portion 112 which is of a greater outer diameter than the inward portion of the frustoconical portion 110 and forms a shoulder 114 therebetween. The cylindrical portion 112 extends axially further into an inwardly-tapering frustoconical portion 116. The frustoconical portion 116 of the locking region 104 extends into the second cylindrical portion 106. The second cylindrical portion 106 includes an annular groove 118 which extends radially inwardly. A conventional O-ring seal 120 is mounted within the annular groove 118 so that an uncompressed outer diameter of the O-ring seal 120 extends slightly beyond the outer diameter of the second cylindrical portion 106.

The hexagonal flange 100 and the first cylindrical portion 102 of the fitting 94 are adapted to receive a fitting 122. The fitting 122 is provided with a hexagonal outer edge 124 and a recess in a center portion of the fitting 122 which comprises first and second concentrically-aligned recesses 126 and 128, respectively. The fitting 122 includes inner and outer surfaces 130 and 132, respectively. The portion of the central recess which corresponds to the first recess 126 of the fitting 122 extends inwardly from and is concentrically aligned with the outer surface 132 and substantially corresponds in outer diameter and inward depth to the hexagonal flange 100 of the fitting 94. The first recess 126 includes an axial discontinuity such as a hexagonal wall (or other polygonal shape), a key, or any other anti-rotation member which prevents the flange 100 from rotating when received within into the fitting 122. The second recess 128 of the fitting 122 extends inwardly from the inner surface 130 and corresponds substantially to the outer diameter of the first cylindrical portion 102 of the fitting 94. The first and second recesses 126 and 128, respectively, intersect at an interior portion of the fitting 122 and define a shoulder 134.

In assembly, the fitting 122 is axially inserted onto the second end 98 of the fitting 94 so that the hexagonal flange 100 rests within the first recess 126 and against the shoulder 134 and the first cylindrical portion 102 extends through the second recess 128. A conventional O-ring seal 136 is mounted onto the remainder of the first cylindrical portion 102 which does not lie within the second recess 128 of the fitting 122. The O-ring seal 136 can extend between the fitting 122 and the cylindrical portion 108 of the locking region 104 to aid in mounting the fitting 122 to the fitting 94. In addition, the outer diameter of the O-ring seal 136 can be of a sufficient width and diameter to abut against a portion of the inner surface 130 of the fitting 122 to further retain the fitting 122 thereto.

To mount the water lead 40 to the socket member 38, the second end 98 of the fitting 94 is inserted within the socket 48. As the water lead 40 is first inserted, the diameter of the second cylindrical portion 106 is sufficiently small to enable the portion 106 to pass within the split ring 76 and into the cylindrical conduit 62. As the water lead 40 is further inserted within the socket 48, the frustoconical portion 116 encounters the inner edge of the split ring 76. Further insertion causes the outer diameter of the split ring 76 to be increased thereby urging the ring 76 into the annular groove 70 as the frustoconical portion 116 and the cylindrical portion 112 are urged past the annular groove 70. In addition, the O-ring seal 120 is compressed and urged within the annular groove 118 of the second cylindrical portion 106 against the inner wall of the cylindrical conduit 62. The O-ring seal 120 preferably fills the annular groove 118 and sealingly presses against the inner wall of the cylindrical wall of the conduit 62 to provide a watertight seal therebetween. As the second end 98 of the fitting 94 is further urged within the particular socket 48, the frustoconical portion 116 of the fitting 94 abuts against the frustoconical portion 74 of the locking region 60 and the cylindrical portion 112 of the fitting 94 rests adjacent the cylindrical conduit 72. The inward bias of the split ring 76 causes the split ring 76 to spring inwardly towards its unextended diameter and thereby rests against the frustoconical portion 110 and the shoulder 114 adjacent the cylindrical portion 112. The O-ring seal 136 is sealingly compressed against the frustoconical portion 58 adjacent the first end 44 of the socket member 38 to provide an additional seal between the fitting 94, the body 42 of the socket member 38, and the hexagonal fitting 122. The abutment of the split ring 76 against the shoulder 114 and the frustoconical portion 110 provides a firm locking engagement of the second end 98 of the fitting 94 within a particular socket 48. Any attempt to axially urge the fitting 98 out of the socket 48 causes the split ring 76 to be urged against the walls of the annular groove 70 and possibly the frustoconical portion 68, thereby preventing the second end 98 of the fitting 94 from being removed from the socket 48 during normal conditions.

If the second end 98 of the fitting 94 needs to be removed from a socket 48 of the socket member 38, the fitting 122 can be broken away or otherwise removed which enables the second end 98 of the fitting 94 to be urged further inwardly within the socket 48 a distance approximately equal to the depth of the second recess 128 of the now removed fitting 122. This further inward urging causes the split ring 76 to be urged against the frustoconical portion 110 and into the annular groove 70. Further annular insertion causes the ring to be urged completely within the annular groove 70 by the cylindrical portion 108. A quick, outer axial thrust of the second end 98 of the fitting 94 causes the second end 98 of the fitting 94 to be moved axially outwardly a sufficient distance so that the split ring 76 does not have the opportunity to resiliently return toward its uncompressed outer diameter and return to its abutting contact against the shoulder 114. Rather, the quick, outer axial movement of the second end 98 of the fitting 94 causes the cylindrical portion 112 or frustoconical portion 116 to be moved adjacent the annular groove 70 which allows the remaining portion of the second end 98 of the fitting 94 to be removed from the socket 48.

As noted above, one or more of the water leads 40 can receive an O-ring seal 136 and a hexagonal fitting 122 and can be axially inserted and locked within a socket 48 on the socket member 38. The hexagonal outer edge 124 of the fitting 122 serves a useful purpose in that the sockets 48 can be aligned in a spaced relationship so that adjacent flat edges of the hexagonal outer surfaces 124 of adjacently-mounted hexagonal fittings 122 abut each other and prevent the rotation of the water leads 40 which could otherwise occur. The rotation of the water leads 40 is undesirable because such rotation could cause the rotating parts to abrade and wear against each other thus decreasing the effectiveness of the sealing rings 120 and 136. In addition, the rotation prevented by the hexagonal outer edges 124 of the adjacently-mounted fittings 122 prevents the perception that the firmly locked water leads are "loose" since the water leads 40 are free to otherwise rotate even though they are securely mounted to the socket member 38. Further, the hexagonal fittings 122 can help align adjacent water leads 40 so that a socket member 38 mounted within a conventional faucet 10 can be easily "press-fit" onto the water leads 40 in a very short time and without requiring the use of tools.

Figure 7:
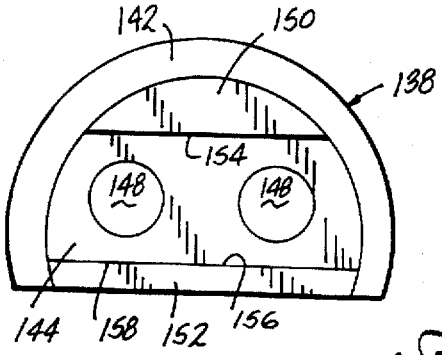
FIG. 7 is a plan view of an alternative embodiment of the socket member of FIG. 2 adapted to receive two water leads.

FIG. 7 shows an alternative embodiment of the socket member 38 shown generally at 138 which comprises a similar body 142 provided with a first end 144 on which two inwardly-extending sockets 148 extend which are similar in configuration as the sockets 48 in the socket member 38 of the first embodiment. It will be understood that additional or fewer sockets 48 can be provided in the first end 144 of the socket member without departing from the spirit of this invention. The first end 144 of the socket member 138 is further provided with a pair of outwardly-extending walls 150 and 152 each of which defines an inward parallel edge 154 and 156, respectively. The parallel edges 154 and 156 of the walls 150 and 152 respectively, define a recess 158 therebetween in which the sockets 148 are located. A water lead 40 provided with O-ring seals 120 and 136 and a hexagonal fitting 100 as described above can be mounted within the sockets 148 so that a pair of outer parallel edges of the hexagonal fitting 100 abut the parallel edges 154 and 156 of the walls 150 and 152, respectively. The abutting contact of an outer edge of the fitting 100 against the parallel edges 154 and 156 prevent the water leads 40 from rotating when locked within the sockets 148. Alternatively, the pair of sockets 148 could be aligned as in the previous embodiment wherein adjacent sides of the hexagonal fittings of a pair of water leads 40 would abut each other and not require the walls 150 and 152.

While particular embodiments of the invention have been shown, it will be understood, of course, that the invention is not limited thereto since modifications may be made by those skilled in the art, particularly in light of the foregoing teachings. For example, the fitting can be formed integrally with the socket member by simply providing another recess, shaped to correspond with the shape of the flange. Reasonable variation and modification are possible within the scope of the foregoing disclosure of the invention without departing from the spirit of the invention.

The embodiments of the invention in which an exclusive property or privilege is claimed are defined as follows:

1. In a faucet assembly including at least one water supply lead with a fitting thereon and a faucet assembly with at least one socket therein adapted to receive the fitting in sealing engagement, one of said water supply lead and said fitting having a portion rotatable relative to the faucet assembly when the fitting is in sealing engagement therewith, the rotatable portion having an annular discontinuity, the improvement comprising:

a member adapted to be positioned between a water supply lead and the faucet assembly when the fitting is received within the socket, said member having a recess with an axial discontinuity adapted to engage the annular discontinuity whereby when the fitting is received within the socket, the rotatable portion will be received within the recess and will be prevented from rotating when the annular discontinuity engages the axial discontinuity.

2. The faucet assembly of claim 1 wherein the annular discontinuity of the rotatable portion has an outer edge, said outer edge comprising a polygonal surface.

3. The faucet assembly of claim 2 wherein the polygonal surface of the rotatable portion is hexagonal.

4. The faucet assembly of claim 1 wherein the annular discontinuity of the rotatable portion has an outer edge, said outer edge having a hexagonal surface.

5. The faucet assembly of claim 1 wherein the recess in said member includes an annular shoulder therein.

6. The faucet assembly of claim 5 wherein the axial discontinuity comprises a polygonal surface.

7. The faucet assembly of claim 6 wherein the polygonal surface comprises a hexagonal surface.

8. The faucet assembly of claim 1 wherein said member further comprises between one and three recesses, said recesses each adapted to receive a water supply lead.

9. The faucet assembly of claim 1 wherein said fitting and said socket have are adapted whereby the mounting of said fitting within said socket does not require the use of tools.

10. The faucet assembly of claim 9 wherein:

said fitting includes a circumferential groove;

said socket includes a circumferential groove;

and further comprising a ring whereby said ring engages said circumferential groove on said fitting and said circumferential groove on said socket when said fitting is received in said socket.

11. In a faucet assembly including at least one water supply lead with a fitting thereon and a faucet assembly with a socket therein adapted to receive the fitting in sealing engagement, one of said water supply lead and said fitting having a portion rotatable relative to the faucet assembly when the fitting is in sealing engagement therewith, the rotatable portion having an annular discontinuity, the improvement comprising:

anti-rotation means adapted to be positioned between the water supply lead and the faucet assembly when the fitting is received within the socket;

said anti-rotation means having a recess with an axial discontinuity adapted to engage the annular discontinuity whereby when the fitting is received within the socket, the rotatable portion will be received within the recess and will be prevented from rotating when the annular discontinuity engages the axial discontinuity.

12. The faucet assembly of claim 11 wherein the annular discontinuity of the rotatable portion has an outer edge, said outer edge comprising a polygonal surface.

13. The faucet assembly of claim 12 wherein the polygonal surface of the rotatable portion is hexagonal.

14. The faucet assembly of claim 11 wherein the annular discontinuity of the rotatable portion has an outer edge, said outer edge having a hexagonal surface.

15. The faucet assembly of claim 11 wherein the recess in said member includes an annular shoulder therein.

16. The faucet assembly of claim 15 wherein the axial discontinuity comprises a polygonal surface.

17. The faucet assembly of claim 16 wherein the polygonal surface comprises a hexagonal surface.

18. The faucet assembly of claim 11 wherein said member further comprises between one and three recesses, said recesses each adapted to receive a water supply lead.

19. The faucet assembly of claim 11 wherein said fitting and said socket are adapted whereby the mounting of said fitting within said socket does not require the use of tools.

20. The faucet assembly of claim 19 wherein:

said fitting includes a circumferential groove;

said socket includes a circumferential groove;

and further comprising a ring whereby said ring engages said circumferential groove on said fitting and said circumferential groove on said socket when said fitting is received in said socket.

* * * * *